US012012845B2

(12) United States Patent
Loh et al.

(10) Patent No.: US 12,012,845 B2
(45) Date of Patent: Jun. 18, 2024

(54) CONVERTIBLE GAUGE MODULE AND SYSTEM

(71) Applicants: Yuh Loh, Cypress, TX (US); Javid Majid, Houston, TX (US)

(72) Inventors: Yuh Loh, Cypress, TX (US); Javid Majid, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 255 days.

(21) Appl. No.: 17/517,188

(22) Filed: Nov. 2, 2021

(65) Prior Publication Data

US 2023/0135161 A1 May 4, 2023

(51) Int. Cl.

| | |
|---|---|
| ***E21B 47/06*** | (2012.01) |
| ***E21B 47/01*** | (2012.01) |
| *E21B 33/12* | (2006.01) |
| *E21B 47/16* | (2006.01) |

(52) U.S. Cl.

CPC ..... *E21B 47/06* (2013.01); *E21B 47/01* (2013.01); *E21B 33/12* (2013.01); *E21B 47/16* (2013.01)

(58) Field of Classification Search

CPC ..... E21B 47/01; E21B 47/06

See application file for complete search history.

(56) References Cited

U.S. PATENT DOCUMENTS 5,366,017 A * 11/1994 Voss, Jr. ..... E21B 33/0355 166/88.4
9,416,606 B2 * 8/2016 Harms ..... E21B 21/10
2022/0220843 A1 * 7/2022 Lafleur ..... G01D 11/245

FOREIGN PATENT DOCUMENTS

CN 1576513 A * 2/2005 ..... E21B 47/00

* cited by examiner

*Primary Examiner* — Jill E Culler

(74) *Attorney, Agent, or Firm* — CANTOR COLBURN LLP

(57) ABSTRACT

A convertible sensor module kit including a housing, a sensor port in the housing and having a seal block receptacle fluidly coupled to the sensor port, and a tubing pressure seal block or an annulus pressure seal block disposed in the receptacle. A module for sensing annulus pressure comprising a housing, a sensor port in the housing and having a seal block receptacle fluidly coupled to the sensor port, and an annulus pressure seal block disposed in the receptacle, the block including a communication channel intersecting a monitor channel, the monitor channel in fluid pressure connection with the sensor port.

9 Claims, 4 Drawing Sheets

CONVERTIBLE GAUGE MODULE AND SYSTEM

BACKGROUND

In the resource recovery and fluid sequestration arts, it is often necessary to monitor pressures in the downhole environment. There are devices that measure tubing pressure. These are effective but the art would well receive alternative constructions that allow greater flexibility with fewer components and convertibility as well.

SUMMARY

An embodiment of a convertible sensor module kit including a housing, a sensor port in the housing and having a seal block receptacle fluidly coupled to the sensor port, and a tubing pressure seal block or an annulus pressure seal block disposed in the receptacle.

An embodiment of a module for sensing annulus pressure comprising a housing, a sensor port in the housing and having a seal block receptacle fluidly coupled to the sensor port, and an annulus pressure seal block disposed in the receptacle, the block including a communication channel intersecting a monitor channel, the monitor channel in fluid pressure connection with the sensor port.

A method for determining a parameter in a borehole comprising determining a parameter of interest, selecting a seal block from the kit, installing the selected seal block in the housing, installing the housing on a tubing member to be monitored.

A borehole system comprising a borehole in a subsurface formation, a string in the borehole, a module constructed using the kit, then module disposed in or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
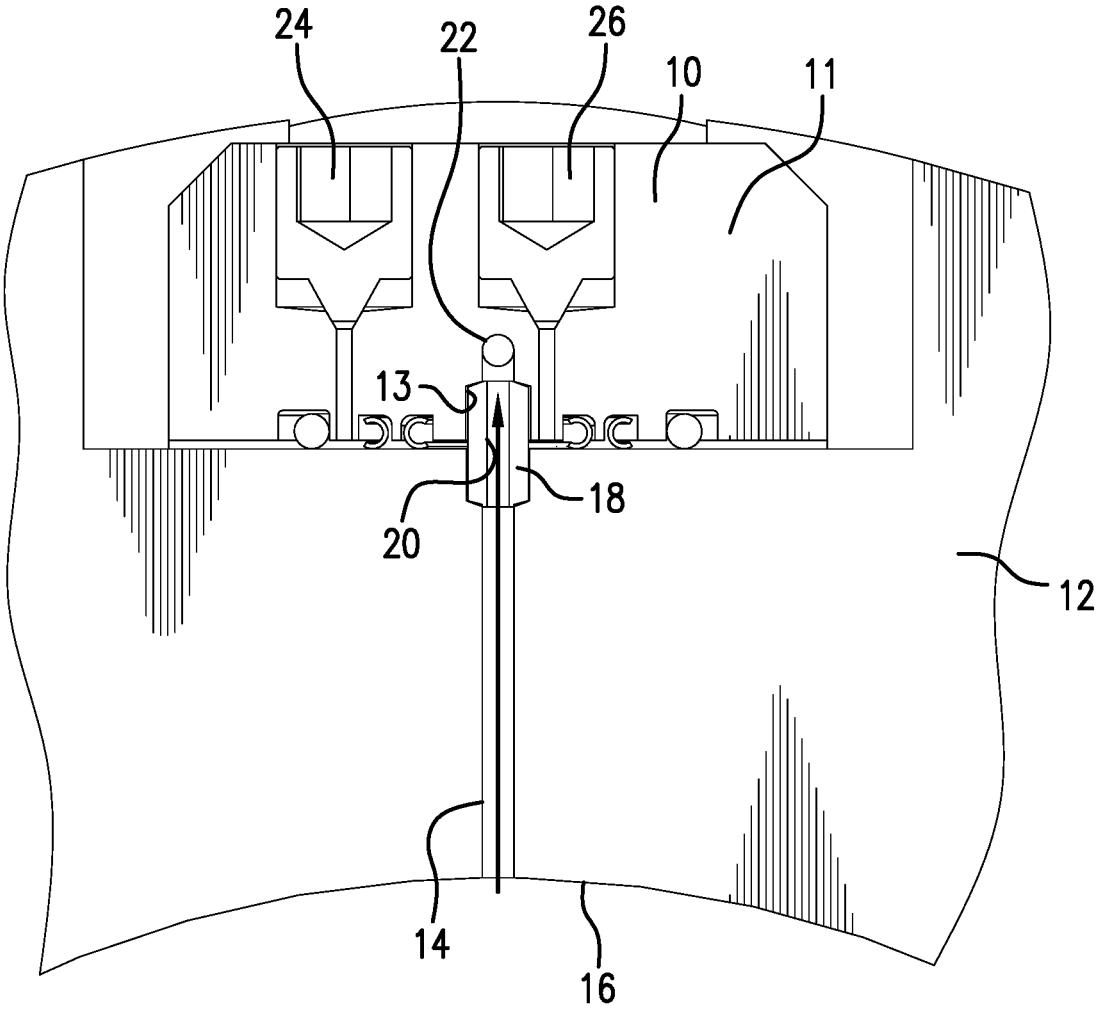
FIG. 1 (PRIOR ART)
FIG. 1 is a view of a prior art tubing pressure module.

Referring to FIG. 1, illustrated is a prior art pressure module 10 mounted to a portion of a tubular member 12, which may be a part of a string in a borehole. The module is commercially available from Baker Hughes Houston Texas and measures and or monitors pressure inside of the tubular member 12 via a pressure pathway 14 extending from an inside diameter 16 of the tubular member 12 into fluid communication with the module 10, including a housing 11 and a sensor (not shown) in the housing 11. The housing 11 further includes a seal block receptacle 13. A tubing pressure seal block 18 is disposed in the receptacle 13 in fluid communication with the pathway 14, the block 18 having a passage 20 fluidly connecting the pathway 14 to a sensor port 22 in the housing 11. Plugs 24 and 26 are testing configurations allowing testing of the various seals in the module 10. The module works well for its intended purpose but is limited to one purpose.

Figure 2:
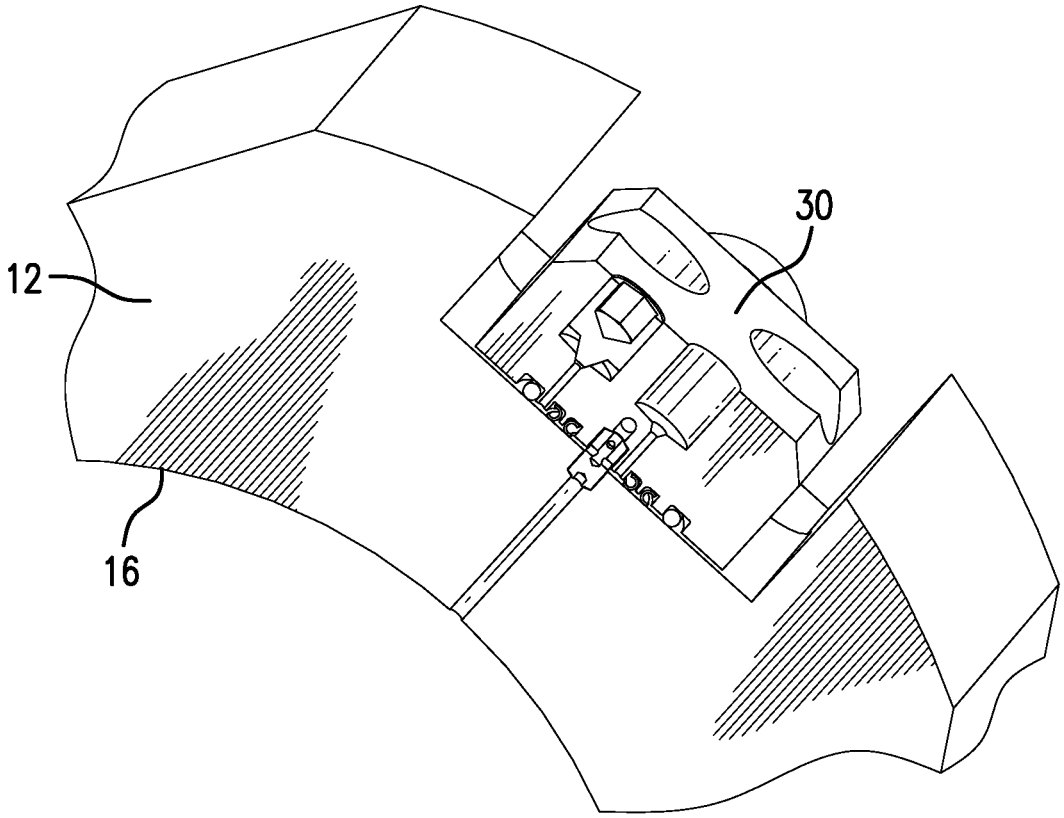
FIG. 2 is a perspective view showing a configurable pressure module as disclosed herein disposed on a segment of tubing.
Figure 3:
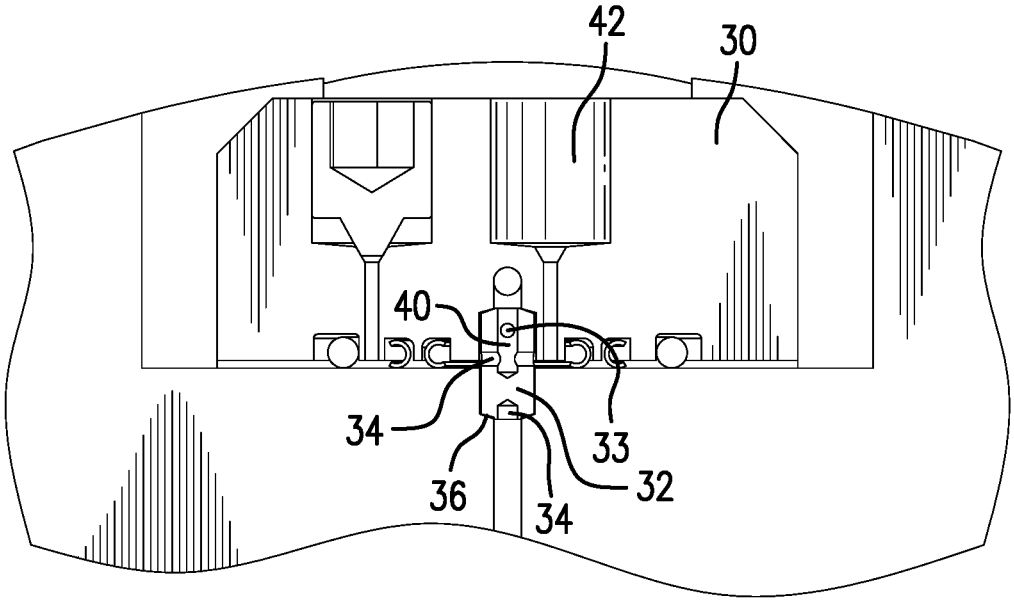
FIG. 3 is a view of the configurable pressure module in the same perspective as the prior art module.
Figure 4:
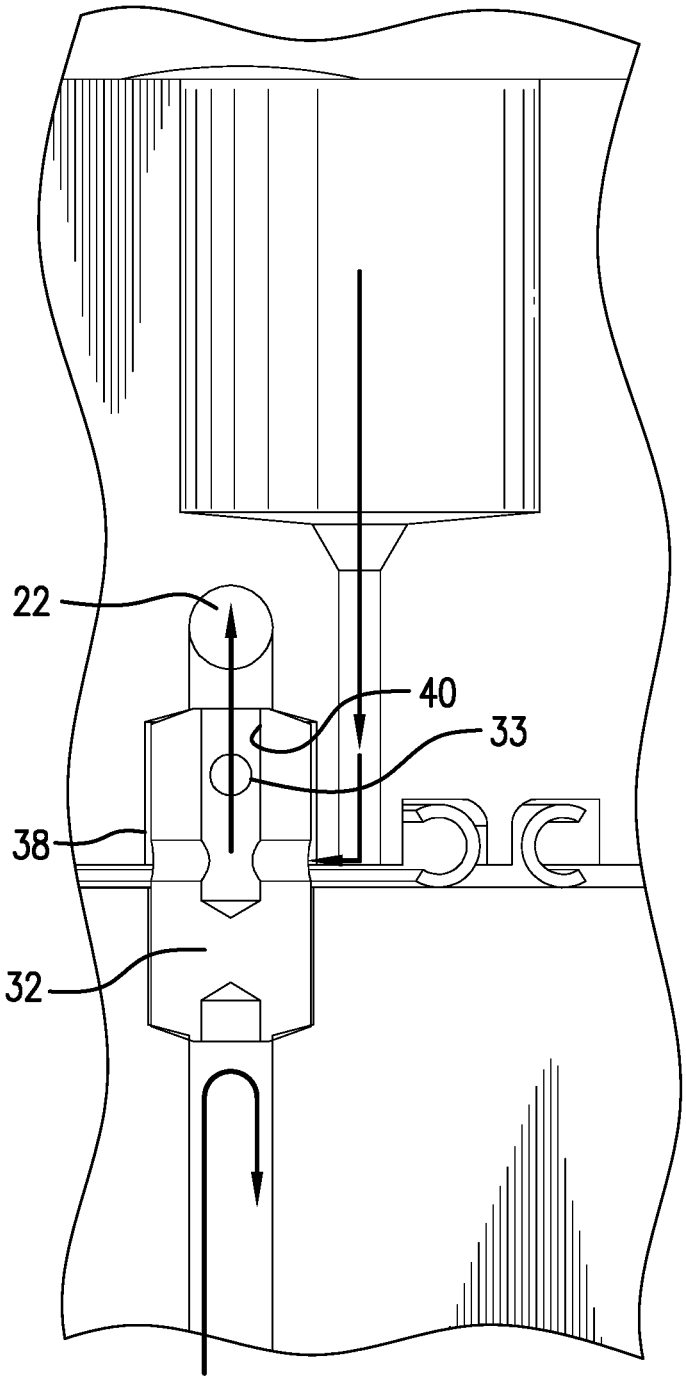
FIG. 4 is an enlarged view of a portion of FIG. 3.

It has been determined by the inventors hereof that the prior art module 10 may be modified to allow for configurability in the field and to reduce inventory items if certain modifications are made to the prior art module 10 to create a new module 30 that it is alternatively capable of measuring or monitoring annulus pressure or measuring/monitoring tubing member pressure. Specifically, and referring now to FIGS. 2-4, an annulus pressure seal block 32 having a different configuration from seal block 18 may be substituted for seal block 18. Seal block 32 includes a dead head for pathway 14 in tubular member 12 thereby preventing communication of fluid pressure from the inside diameter 16 to the module 30. It should be evident from the drawing that the dead head nature of block 32 still includes a recess 34. Recess 34 is useful in improving the metal-to-metal seal capability of the block 32 with the member 12 at 36. Block 32 further includes a communication channel 38 that intersects with a monitor conduit 40. Monitor conduit 40 conveys pressure to the sensor port 22. In an embodiment the receptacle 13 is of larger dimensions than the seal block 32 so that fluid from the annulus may move about the seal block to access additional openings therein such as opening 33. With the module 30 configuration, pressure from an annular space about the tubular member 12 is conveyed through the seal block 32 via plug port 42 due to the removal of plug 26. Since port 42 is exposed to annulus pressure, the modification of module 10 to have the block 32 instead of block 18 and the removal of plug 26 allows the balance of the module 10 to operate as it would have done previously but be sensitive to annulus pressure instead of tubing pressure. The pressure pathway that occurs in Module 30 is easily apprehended in FIG. 4 where arrow 34 identifies the tubing pressure being dead headed and arrow 36 identifies the annulus pressure being conveyed to the sensor port 22.

Advantageously, the end user may select either block 32 or block 18 to insert into the module 30 or 10, respectively, to monitor a pressure source (annulus or tubing, respectively), as desired. This may be done at a rig site in real time. The module may be sold as a kit including both blocks 18 and 32 so that configuration at the wellsite into a module 10 or a module 30 is an easily accomplished selection for an operator.

Figure 5:
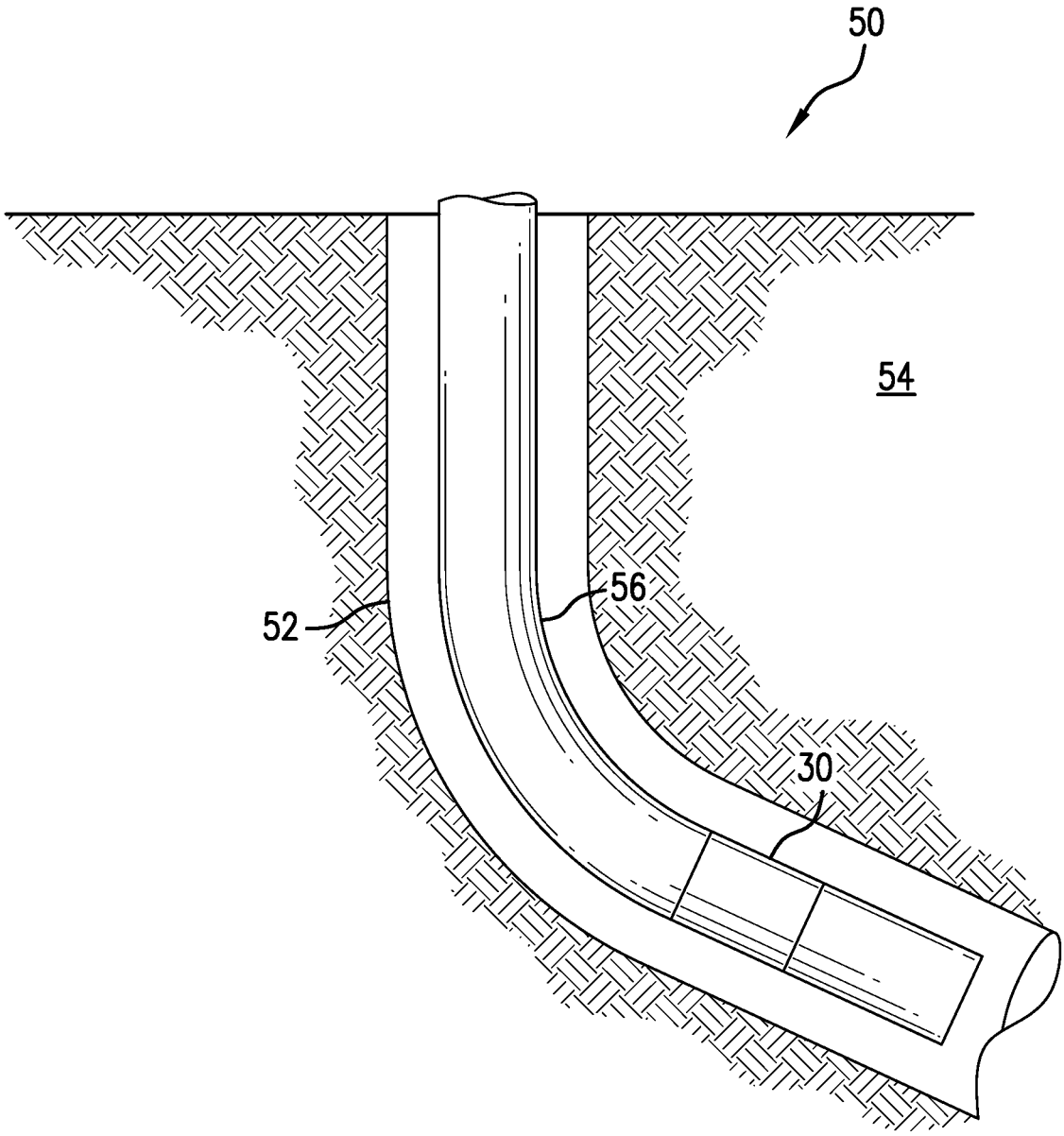
FIG. 5 is a schematic view of a borehole system including the pressure module as disclosed herein.

Referring to FIG. 5, a borehole system 50 is schematically illustrated. The system 50 includes a borehole 52 in a subsurface formation 54. A string 56 is disposed in the borehole 52. A module 30 is disposed within or as a part of the string 56.

Set forth below are some embodiments of the foregoing disclosure:

Embodiment 1: A convertible sensor module kit including a housing, a sensor port in the housing and having a seal block receptacle fluidly coupled to the sensor port, and a tubing pressure seal block or an annulus pressure seal block disposed in the receptacle.

Embodiment 2: The module as in any prior embodiment wherein the tubing pressure seal block includes a passage therein to connect tubing pressure to the sensor port.

Embodiment 3: The module as in any prior embodiment wherein the annulus pressure seal block includes a communication channel therein to connect annulus pressure to the sensor port.

Embodiment 4: The module as in any prior embodiment wherein the annulus pressure seal block includes a monitor conduit between the communication channel and the sensor port.

Embodiment 5: The module as in any prior embodiment wherein the annulus pressure seal block includes an opening in addition to the communication channel feeding the monitor conduit.

Embodiment 6: The module as in any prior embodiment wherein the annulus pressure seal block includes a recess therein, the recess providing resilience in the annulus seal block to energize a metal-to-metal seal between the seal block and a tubing member upon which the module kit is installed.

Embodiment 7: The module as in any prior embodiment wherein the receptacle is of dimensions larger than dimensions of the annulus pressure seal block.

Embodiment 8: A module for sensing annulus pressure comprising a housing, a sensor port in the housing and having a seal block receptacle fluidly coupled to the sensor port, and an annulus pressure seal block disposed in the receptacle, the block including a communication channel intersecting a monitor channel, the monitor channel in fluid pressure connection with the sensor port.

Embodiment 9: The module as in any prior embodiment further including an opening intersecting the monitor conduit.

Embodiment 10: A method for determining a parameter in a borehole comprising determining a parameter of interest, selecting a seal block from the kit as in any prior embodiment, installing the selected seal block in the housing, installing the housing on a tubing member to be monitored.

Embodiment 11: A borehole system comprising a borehole in a subsurface formation, a string in the borehole, a module constructed using the kit as in any prior embodiment, then module disposed in or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A convertible sensor module kit comprising:

a housing;

a sensor port in the housing and having a seal block receptacle fluidly coupled to the sensor port; and a tubing pressure seal block configured to be disposed in the receptacle to create a tubing pressure sensor module when the tubing pressure seal block is disposed in the receptacle; and an annulus pressure seal block configured to be disposed in the receptacle to create an annulus pressure sensor module when the annulus pressure seal block is disposed in the receptacle.

2. The module kit as claimed in claim 1 wherein the tubing pressure seal block includes a passage therein to connect tubing pressure to the sensor port.

3. The module kit as claimed in claim 1 wherein the annulus pressure seal block includes a communication channel therein to connect annulus pressure to the sensor port.

4. The module kit as claimed in claim 3 wherein the annulus pressure seal block includes a monitor conduit between the communication channel and the sensor port.

5. The module kit as claimed in claim 4 wherein the annulus pressure seal block includes an opening in addition to the communication channel feeding the monitor conduit.

6. The module kit as claimed in claim 1 wherein the annulus pressure seal block includes a recess therein, the recess providing resilience in the annulus seal block to energize a metal-to-metal seal between the seal block and a tubing member upon which the module kit is installed.

7. The module kit as claimed in claim 1 wherein the receptacle is of dimensions larger than dimensions of the annulus pressure seal block.

8. A method for determining a parameter in a borehole comprising:

determining a parameter of interest;

selecting a seal block from the kit as claimed in claim 1;

installing the selected seal block in the housing;

installing the housing on a tubing member to be monitored.

9. A borehole system comprising:

a borehole in a subsurface formation;

a string in the borehole;

a module constructed using the kit as claimed in claim 1,
then module disposed in or as a part of the string.

* * * * *